US007264009B2

(12) United States Patent
Gregory

(10) Patent No.: US 7,264,009 B2
(45) Date of Patent: Sep. 4, 2007

(54) CLEANING SYSTEM AND METHOD OF USE

(76) Inventor: David B. Gregory, 1009 S. Henry St., Bay City, MI (US) 48706

( * ) Notice: Subject to any disclaimer, the term of this patent is extended or adjusted under 35 U.S.C. 154(b) by 0 days.

(21) Appl. No.: 11/476,453

(22) Filed: Jun. 28, 2006

(65) Prior Publication Data

US 2006/0237040 A1 Oct. 26, 2006

Related U.S. Application Data

(62) Division of application No. 10/994,562, filed on Nov. 22, 2004, now Pat. No. 7,159,598.

(60) Provisional application No. 60/523,554, filed on Nov. 20, 2003.

(51) Int. Cl.
*B08B 3/02* (2006.01)
*B08B 9/093* (2006.01)

(52) U.S. Cl. ..... 134/167 R; 134/102.1; 134/102.2; 134/103.1; 134/103.2; 134/105; 134/166 R; 134/169 R; 134/172; 134/198

(58) Field of Classification Search ..... 134/88, 134/90, 92, 94.1, 95.3, 99.1, 102.1, 102.2, 134/103.1, 103.2, 105, 166 R, 167 R, 169 R, 134/170, 198, 172
See application file for complete search history.

(56) References Cited

U.S. PATENT DOCUMENTS

| | | | | |
|---|---|---|---|---|
| 3,188,238 | A * | 6/1965 | Lyon | 134/24 |
| 4,341,232 | A * | 7/1982 | Maton | 134/107 |
| 4,941,491 | A * | 7/1990 | Goerss et al. | 134/111 |
| 5,301,702 | A * | 4/1994 | McKinney | 134/167 R |
| 5,711,819 | A * | 1/1998 | Miyasaki | 134/11 |
| 6,557,566 | B1 * | 5/2003 | Rudolfs | 134/22.18 |
| 2003/0205247 | A1 * | 11/2003 | Lengling et al. | 134/22.1 |

* cited by examiner

*Primary Examiner*—Zeinab El-Arini
(74) *Attorney, Agent, or Firm*—Reising, Ethington, Barnes, Kisselle, P.C.

(57) ABSTRACT

A cleaning apparatus is provided for cleaning an inner surface of a container. A spray head is arranged for operable fluid communication with a fluid pump and has a nozzle configured to disperse liquid in a mist. A mount carries the spray head and is removably supportable on a container having an inner surface to be cleaned. When removably supported on a container, the mount supports the spray head in a position within the container where the spray head can coat the inner surface of the container with mist.

21 Claims, 7 Drawing Sheets

CLEANING SYSTEM AND METHOD OF USE

CROSS-REFERENCE TO RELATED APPLICATIONS

This application is a divisional of U.S. patent application Ser. No. 10/994,562 filed Nov. 22, 2004, now U.S. Pat. No. 7,159,598, and claims the benefit of U.S. Provisional Application No. 60/523,554, filed Nov. 20, 2003, which is incorporated herein by reference in its entirety.

STATEMENT REGARDING FEDERALLY SPONSORED RESEARCH OR DEVELOPMENT

Not Applicable

BACKGROUND OF THE INVENTION

1. Field of the Invention

This invention relates generally to a cleaning apparatus, and more particularly to a cleaning apparatus and its method of use for dispensing fluid under pressure onto a surface or surfaces being cleaned.

2. Description of Related Art

Generally, large containers, such as rail car tanks for example, or other vessels used in transporting liquids, accumulate a build-up of material on interior tank surfaces over time. This is particularly troublesome with solutions prone to build-up on surfaces in the form of solids, sludges, and slimes, such as occurs with latex, silicone, enamel, and the like. To avoid contamination, when the particular liquid is emptied from the tank, it is necessary to clean the tank prior to reusing the tank. Cleaning the tank typically involves one or more persons climbing into the tank and using an extremely high pressure, e.g. 20,000-40,000 psi, power wash hose to remove the build-up from the interior tank surfaces. Generally, each person cleaning the tank is capable of cleaning a single surface at any given moment in time. Using high pressure hoses to clean the tanks is not only time consuming, and thus, costly, but it can prove hazardous if a person comes in contact with a high pressure jet stream. In addition, a person within the tank must often take precautions to avoid exposure to potentially hazardous chemicals and dangers of working in a confined space.

SUMMARY OF THE INVENTION

According to the invention a cleaning apparatus is provided for cleaning an inner surface of a container. The apparatus comprises a fluid pump, a first spray head arranged for operable fluid communication with the fluid pump and having a nozzle configured to disperse liquid in a mist, and a mount carrying the first spray head. The mount is configured to be removably supported on a container having an inner surface to be cleaned. The mount is further configured to support the first spray head in a position within the container to be cleaned.

According to another aspect of the invention the first spray head is arranged to operate in a closed recirculatory loop with the pump, the pump being configured to draw liquid from a pool of liquid formed in the container from liquid dispersed into the container by the first spray head, and to pump that liquid back to the first spray head in a recirculatory fashion.

According to another aspect of the invention an enzymatic solution is arranged for fluid communication with the first spray head and the first spray head is configured to disperse the enzymatic solution in a mist.

According to another aspect of the invention the cleaning apparatus includes a second spray head carried by the mount in a position to be disposed within a container to be cleaned when the mount is supported on such a container, the second spray head having a nozzle configured to dispense liquid in a high pressure liquid stream.

According to another aspect of the invention a method is provided for cleaning an inner surface of a container using a cleaning apparatus comprising a fluid pump in operable fluid communication with a first spray head including a misting nozzle, and a mount carrying the first spray head. The method includes the steps of removably supporting the mount on a container to be cleaned such that the first spray head is positioned within the container to be cleaned, providing a supply of liquid cleaner solution to the pump, actuating the pump to provide pressurized liquid cleaner solution to the first spray head, dispensing the liquid cleaner solution as a mist into the container through the first spray head, and rinsing the liquid cleaner solution from the tank.

According to another aspect of the inventive method, the step of dispensing the liquid cleaner solution includes creating a pool of the liquid cleaner solution within the container, and the step of removably supporting the mount includes disposing the first spray head in the container above the pool of liquid cleaner solution and in operable closed loop fluid communication with the pool of liquid cleaner solution.

According to another aspect of the inventive method, a second spray head is provided for dispensing the liquid cleaner solution in a controlled high pressure liquid jet stream, and the inner surface of the container is impinged with a high pressure jet stream of the liquid cleaner solution by dispensing the liquid cleaner solution from the second spray head after the step of dispersing the liquid cleaner solution through the first spray head.

According to another aspect of the inventive method the step of providing the liquid cleaner solution includes providing an enzymatic solution.

BRIEF DESCRIPTION OF THE SEVERAL VIEWS OF THE DRAWINGS

These and other features and advantages will become apparent from the following detailed description and drawings of one or more embodiments of the invention, in which.

DETAILED DESCRIPTION OF THE PREFERRED EMBODIMENTS

Referring in more detail to the drawings, FIGS. 1A-1E illustrate a cleaning system 10 generally suitable for cleaning interior and/or exterior surfaces as desired, and is shown here, by way of example and without limitations, being used to clean an inner surface 12 of a rail car 14. The cleaning system 10 can be used to clean an inner and/or outer surface of any container, tank, vessel, pipe, or the like. The cleaning system 10 allows the rail car 14 to be cleaned in the absence of a person being present in the tank, thereby eliminating potential sources of hazard to a person, such as being exposed to an extremely high pressure jet stream of liquid, e.g., 20,000-40,000 psi, or being exposed to toxic chemicals. In addition, the cleaning system 10 greatly reduces the amount of water consumed during the cleaning process, thus, reducing the associated costs for cleaning the rail car 14.

Figure 1A:
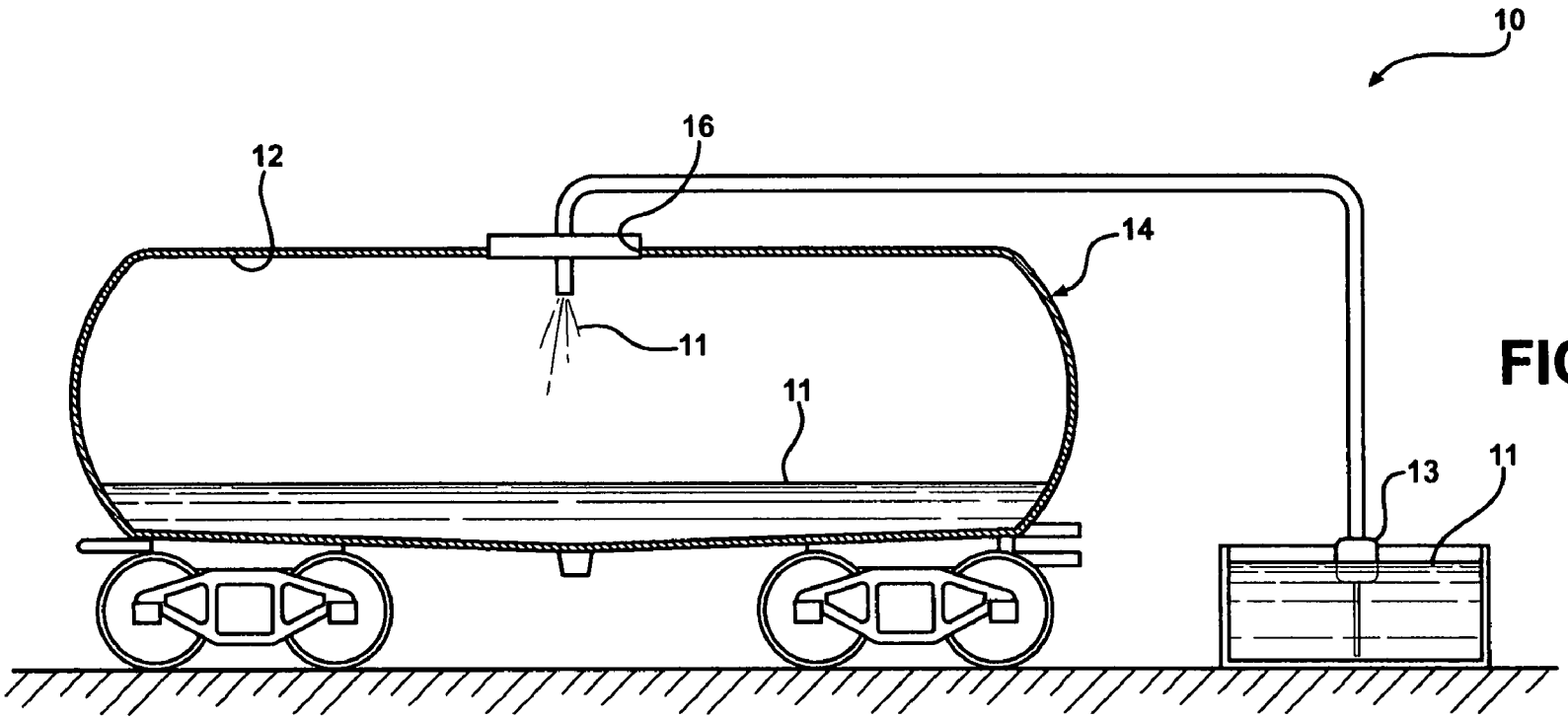
FIGS. 1A-1E are schematic diagrams representing a cleaning system according to one embodiment of the invention.

In FIG. 1A, the rail car 14 is shown having an enzymatic cleaner solution 11 dispensed therein. The cleaner solution 11 may be purchased from ReNew Systems, Inc., of Bay City, Mich., and may be referenced under the product designation Silzyme™ cleaner. The environmentally non-toxic enzymatic solution 11 is generally produced as a base solvent mixture having no anti-bacterial activity and including a surfactant-penetrant-releasing agent (A) and an enzyme component solution (AB), such as can be purchased from Renew Systems, Inc., of Bay City, Mich., under the product designation Silzyme™, referred to hereafter as (B). The liquid mixture (A) may include N-Methyl-2-Pyrrolidone as a surfactant-solvent (2.3-2.4%), ethoxylated octyl phenol as a binder-thickener (2.2-2.3%) and texanol (1.5-1.6%) as a penetrant with the balance typically water. The enzymatic solution (B) may contain one or more enzymes such as lipase, alpha-amylase, protease (1.8-1.9%), or the like, or a mix thereof in an enzyme protectant stabilizer solution including propylene glycol (1.8-1.9%), or the like. The mixture of (A) and (B) is generally in the volume/ratio of at least 90 parts (A) to 10 parts (B) or alternatively 10 parts (A) to 1 part (B), with the percentage indicated by volume. The resulting mixture is blended for about two hours, and thereafter, turbidity and pH measurements are taken. The term enzyme is intended herein to include the well known complex proteins produced by living cells, of high molecular weights, and consisting of multiple amino acids combined in a characteristic sterically oriented structure, and newer and genetically engineered enzyme compositions. A variety of basic enzyme types may include hydrolases, isomerases, ligases, lyases, oxidoreductases, and transferases. More specifically, the enzyme may come from the fermentation of a strain of *Bacillus licheniformis*. The percentage of enzymes by volume used in part (B) may be in the range 0.5-3% by volume.

Upon measuring the pH of the mixture (AB), it is determined how much of a base solution, such as sodium borate ($NaBO_4$) mixed in water, designated hereafter as (C), needs to be added to the mixture (AB) to bring the mixture up to a pH neutral range, defined as being between 6-8 on the pH scale. Upon adding the determined amount of the base solution (C) to the mixture (AB), the pH is measured again (see FIG. 3). If the pH is within the designated pH neutral range, then the resulting mixture (AB) and (C), hereafter referred to as (ABC), is ready for use. However, if the mixture (ABC) is not within the pH neutral range, more base solution (C) may be added to raise the pH level, or an acidic solution, such as citric acid or hydrochloric acid solution, for example, can be added to the mixture (ABC) to reduce the pH. The Silzyme™ solution may be diluted with water to provide about a 20 percent concentration of Silzyme™ cleaner to water. It should be recognized that other cleaner solutions may be used with the cleaning system 10, such as, by way of example, and without limitations, Aqueous Reactivator™, Xzyme™, and Decontaminator™, all available from ReNew Systems, Inc. Preferably, about 500 to 1500 gallons of the cleaner solution 11 are dispensed into the rail car 14, when the rail car 14 generally has a 22,000 gallon tank capacity. It should be recognized that any suitable pump 13 may be used to dispense the cleaner solution 11 through an opening 16 in the rail car 14.

Figure 1B:
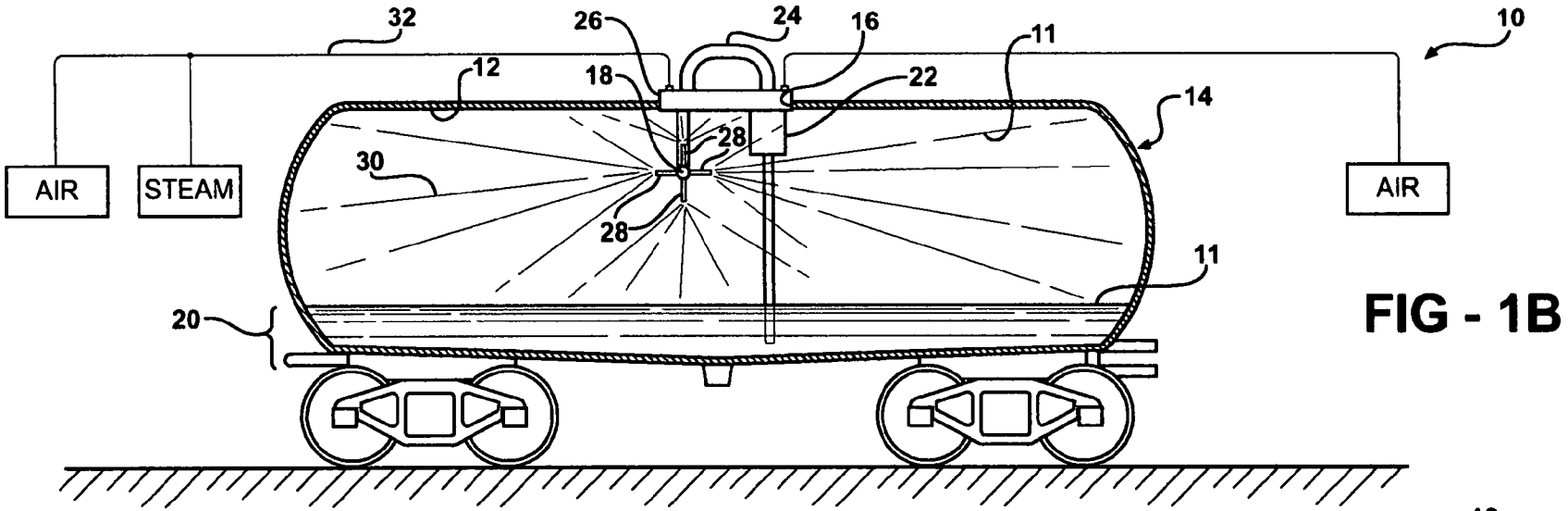
Figure 1C:
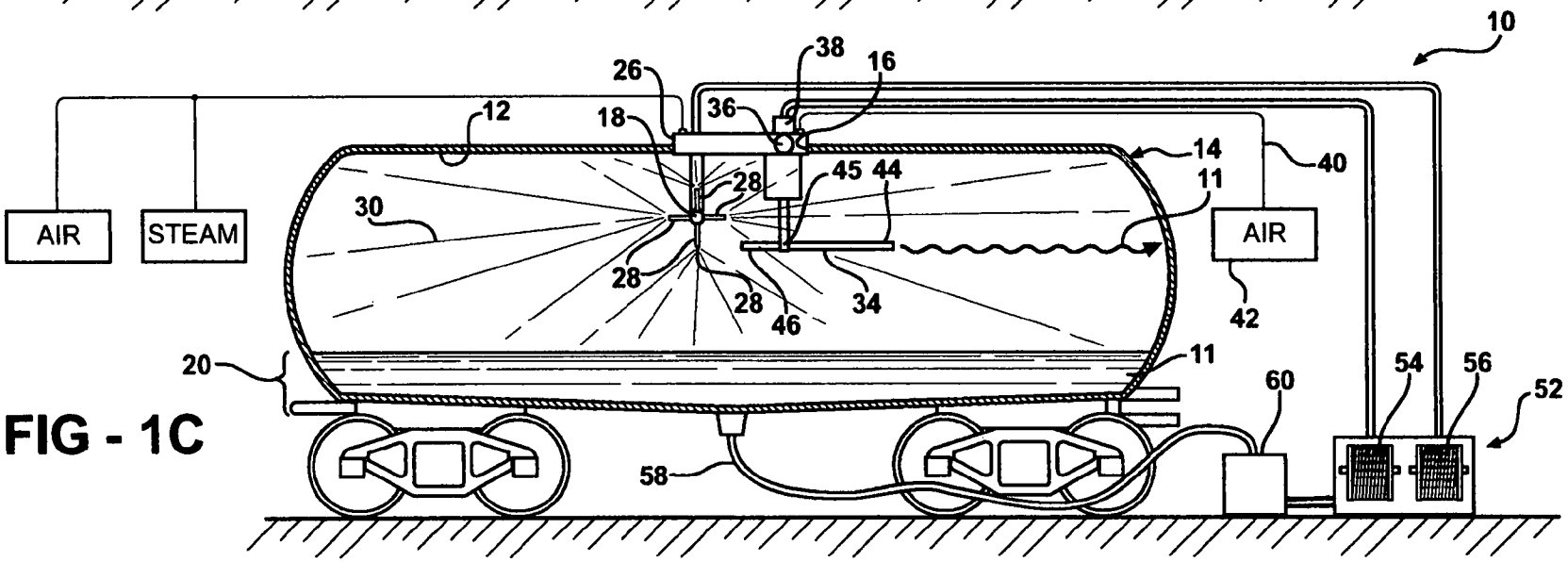

As shown in FIG. 1B, upon dispensing the desired amount of cleaner solution 11 into the rail car 14, a first spray head, referred to hereafter as a misting head 18, is disposed within the rail car 14 to disperse a fine mist of the cleaner solution within the rail car in a soaking or misting procedure and to create a pool of the cleaner solution 11 within the tank as shown in FIGS. 1B and 1C. As is also shown in FIGS. 1B and 1C, the misting head 18 is disposed above the pool of cleaner solution 11. One embodiment of the misting head 18 is readily available from Auto Jet Technologies, a division of Spraying Systems Company of Wheaton, Ill., U.S.A., under model number 8050. The misting head 18 may be in operable fluid communication with the pool of cleaner solution 11 in a bottom portion 20 of the rail car 14, and a sump pump 22 may be used to pump the cleaning fluid from the pool of cleaner solution 11 through a fluid line 24 to the misting head 18 in a recirculatory fashion to issue fine droplets on the order of a micron or less in diameter. To facilitate creating a closed-loop environment, the misting head 18 and the sump pump 22 may be attached to a flange mount or lid 26 and depend therefrom into the rail car 14. The lid 26 may be sized to create a liquid tight seal with the opening 16 in the rail car 14. The recirculatory, closed-loop flow of the cleaning fluid is best shown in FIGS. 1B, 1C, and schematically in FIGS. 6, and 7.

The misting head 18 may have a plurality of spray nozzles 28 for dispensing the cleaner solution 11 in spray mist 30 over a 360 degree circular spray pattern. The fog like atmosphere created by the fine spray mist 30 of cleaner solution 11 causes the inner surface 12 of the tank above the pool of cleaner solution 11 to be completely covered with the cleaner solution 11 as shown in FIGS. 1B and 1C. Depending on the severity of the cleaning required, the recirculatory misting procedure may continue in a soaking step between about 6-10 hours, as needed. Some dwell time before other processing may also be incorporated in the soaking step so long as the temperature at the interior surface is substantially maintained. The misting procedure does not require the continued presence of a person, and can be left under automated controls such as timers for turning on and off the pump 22, and the like.

To facilitate cleaning efficacy, a heat source and atomizer, such as, by way of example and without limitations, a steam line or combination air/steam line 32, may be connected to the misting head 18 to communicate steam and/or air under pressure with the cleaner solution 11 to heat and atomize the cleaner solution as it is being dispensed from the spray nozzles 28. When cleaning a latex or similar composition, the cleaner solution 11 may be heated to a temperature between about 145-160 degrees Fahrenheit (F) to ultimately bring the temperature of the fog inside the rail car 14 to a temperature between about 145 and 160 degrees (F). Upon the cleaner solution and the tank interior wall surface reaching the upper temperature limit of 160 (F), with the fog filling the tank, the steam can be shut off, and thereafter the pressure of the air alone can be used to disperse the recirculating heated cleaner solution from the misting head 18. The heating temperature may be other than as described above. For example, if cleaning a silicone or foods, by way of example and without limitations, the temperature could be lower, such as about 120 degrees (F.).

Upon completion of the misting procedure described above, as shown in FIG. 1C, a second spray head, referred to hereafter as a jet stream head 34, may be supported above the pool of liquid cleaner solution 11 and used to dispense the cleaner solution 11 in a high pressure stream to impinge the inner surface 12 of the rail car 14 in a washing or blasting procedure. The cleaner solution in this embodiment may be withdrawn via drain line 58 and furnished to the jet head 34 in a manner that presently will be described in detail. Depending on the severity of cleaning required, the washing procedure is generally performed between about 4-16 hours. The misting head 18 can still be used in conjunction with the jet stream head 34, as shown in FIG. 1C, if desired. The jet stream head 34 may be in operable fluid communication with the pool of cleaner solution 11 in the rail car 14 in a recirculatory mode, as shown in FIG. 1C, though the jet stream head 34 could be arranged for fluid communication with a different source of cleaner solution external to the rail car 14 if required to remove the particulate material. The jet stream head may also be obtained from the Auto Jet Technologies division previously mentioned. To facilitate creating a liquid tight sealed environment, the jet stream head 34 may be attached to the lid 26 and depend therefrom a predetermined distance into the rail car 14. The jet stream head 34 may be movably supported to allow cleaner solution to be dispensed in different directions within the rail car 14. The jet stream head 34 may be pivotally supported via a liquid tight ball joint 36 so it can be oriented as desired within the rail car 14. Additionally, a liquid tight compression sleeve 38 may be used to allow the jet stream head 34 to be raised and lowered within the rail car 14, as necessary to position the jet stream head 34 to a desired height within the rail car 14.

The jet stream head 34 may be operably connected to an air line 40 (FIG. 7), wherein the air line 40 channels pressurized air provided by an air motor or compressor 42, with an air pressure resulting generally between 5-20 psi. The pressurized air causes a spray nozzle or nozzles 44 of the jet stream head 34 to rotate so that the entire inner surface 12 of the rail car 14 is impinged by the high pressure stream over a time of about 10-45 minutes. To facilitate a balanced 360 degree rotation of the spray nozzle 44, a counterweight 46 or second spray nozzle may be attached to the jet stream head 34 opposite the spray nozzle 44 so the spray nozzle 44 or nozzles rotate about a centroid 45 of the jet stream head 34.

Figure 5:
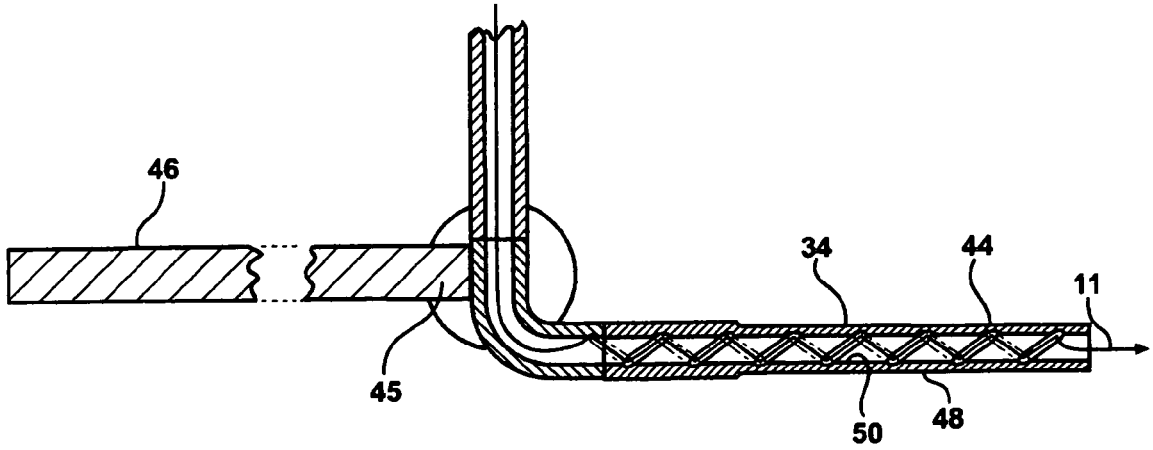
FIG. 5 is a partial cross-sectional view of one spray nozzle assembly according to one embodiment of the invention.

As shown in FIG. 5, to facilitate creating the high pressure stream, the spray nozzle 44 has a barrel 48 that may include a rifled or helical inner groove 50. The helical groove 50 may make a complete 360 degree turn between about 4-9 times per foot, such that the cleaner solution 11 dispensed under pressure though the spray nozzle 44 takes on a vortical stream pattern to facilitate maintaining a relatively high momentum upon affecting the inner surface 12 of the rail car 14. The jet stream head 34 is generally capable of dispensing the cleaner solution 11 radially outwardly about 40 feet with considerable force, thereby rendering the jet stream head 34 capable of cleaning a tank having an inner span or diameter of about 80 feet. The jet stream is dispensed under a pressure generally between 500-2000 psi, while consuming generally between 3-45 gpm of solution from the source of fluid supply, whether it be from the rail car 14 being cleaned in a recirculation mode of operation from supply 11, or from a separate container external to the rail car 14. Depending on the nature of the cleaning being performed, other types and models of spray nozzle assemblies may be used in place of the misting head 18 and the jet stream head 34, as desired.

Figure 2:
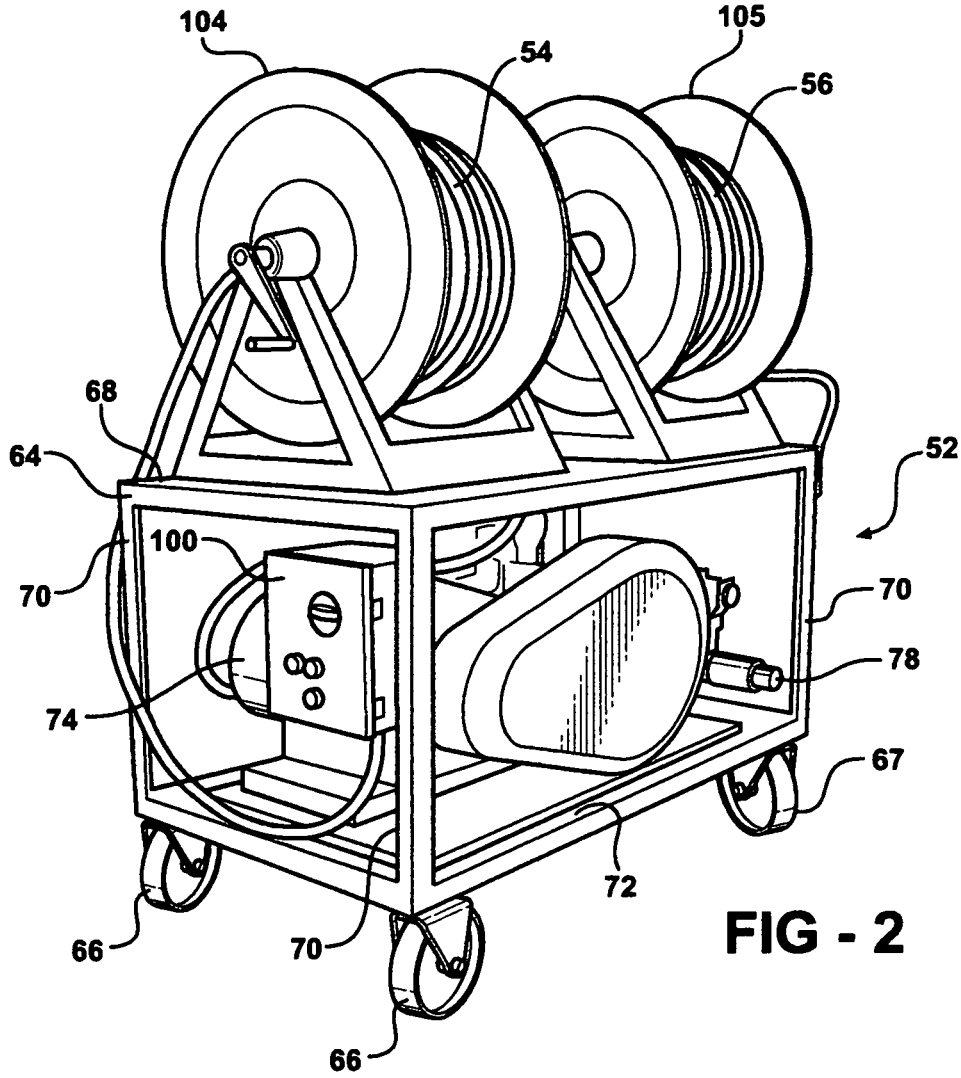
FIG. 2 is a front perspective view of a pump apparatus according to one embodiment of the invention.
Figure 3:
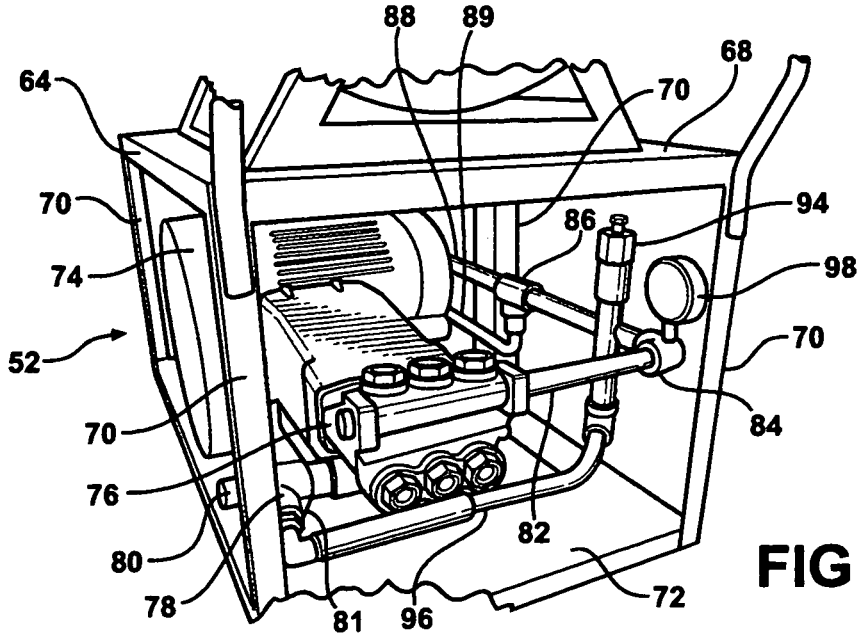
FIG. 3 is a rear perspective view of the apparatus of FIG. 2.
Figure 4:
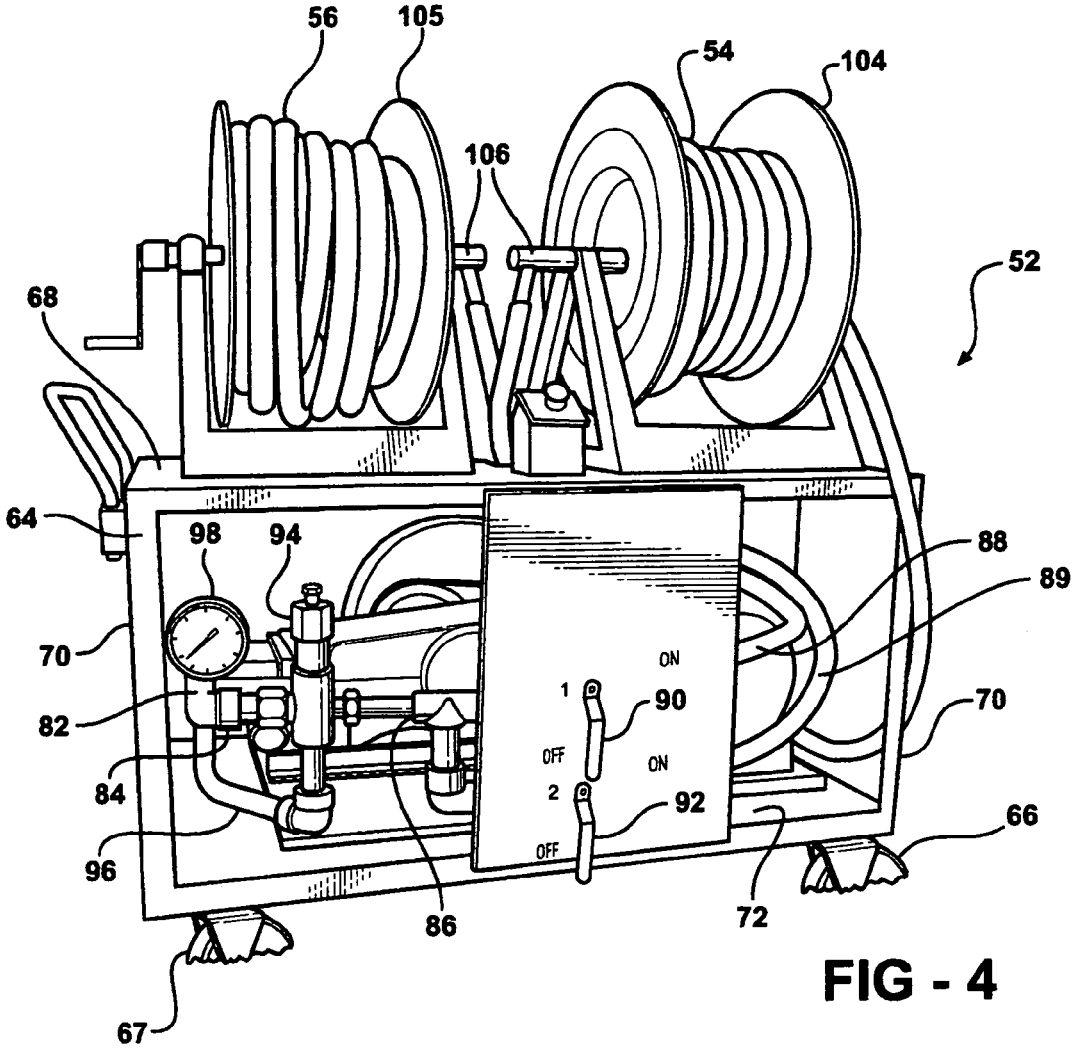
FIG. 4 is a side view of the apparatus of FIG. 2.

The jet stream head 34 may be attached in a closed loop to a pump assembly represented generally at 52 in FIGS. 2-4. The pump assembly 52 has at least one, and may have, as shown here, a pair of hoses 54, 56, with one of the hoses 54 being arranged for fluid communication with the misting head 18, and the other of the hoses 56 being arranged for fluid communication with the jet stream head 34. As such, the pair of hose lines 54, 56 facilitates cleaning at least one or more surfaces with the same cleaning system 10 at the same time.

The return hose 58 may be connected to a lowermost portion of the rail car 14 so the cleaner solution 11 can be routed with the assistance of gravity to the pump assembly 52. A filter 60 capable of filtering out sediment greater in size than about 5-10 microns may be incorporated in line with the return line 58 to remove any sediment from the cleaner solution prior to its returning to the pump assembly 52. By way of example, and without limitations, the filter 60 could be provided in a 55 gallon drum and be constructed to be an intentional "weak link" in the system. Accordingly, if the pump assembly 52 is being starved of fluid, or if some other problem arises in the flow of fluid throughout the cleaning system 10, the drum can be designed to collapse and shut down the system 10, thereby minimizing or eliminating any damage to other components within the system 10.

Figure 1D:
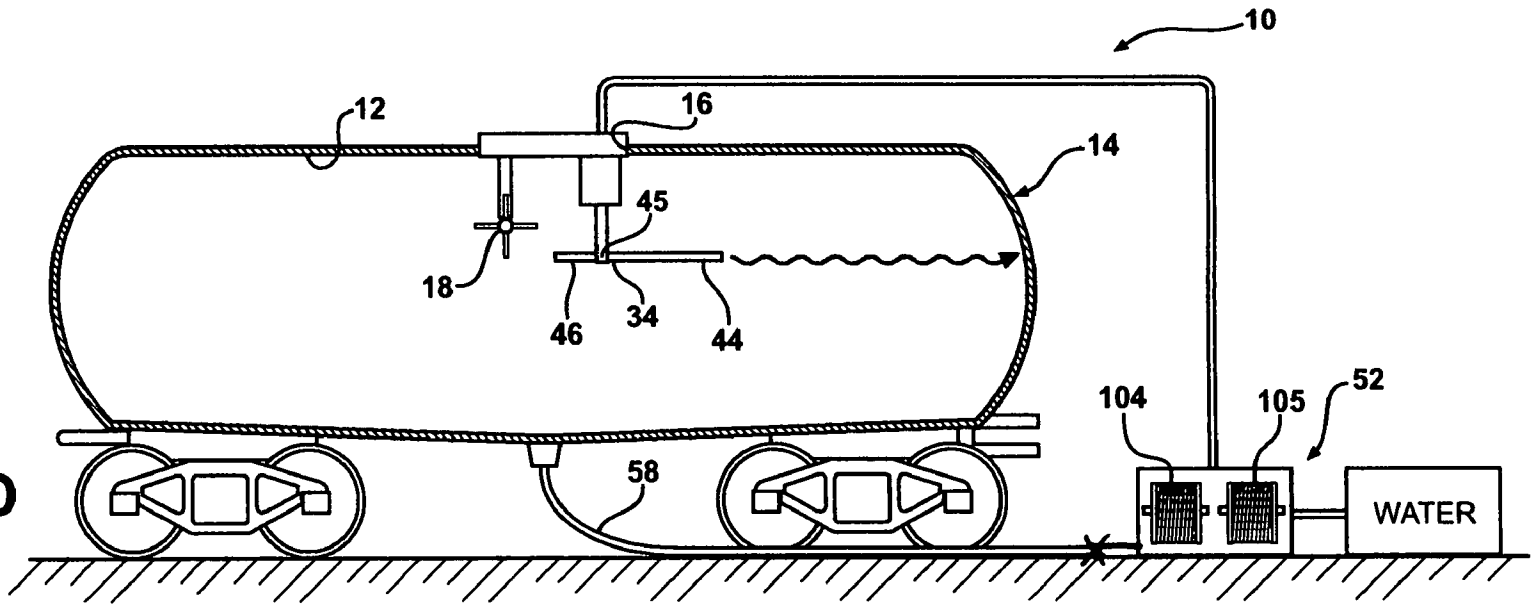

Upon completion of the washing procedure, as shown in FIG. 1D, a rinsing procedure may be performed by directing water or some other mild rinse solution via the pump assembly 52 to the jet spray head 34. The water from the jet spray head 34 impinges the inner surface 12 of the rail car 14, as described above, and the resulting flow of water may be routed via the return hose 58 to a drain or collection area. Rather than using gravitational assistance to allow the cleaner solution and water to flow from the rail car 14 via the return hose 58, a pump (not shown) could be used in combination with gravity, or solely, if the tank being cleaned is below ground, or otherwise in a position rendering gravitational assistance impossible.

Figure 1E:
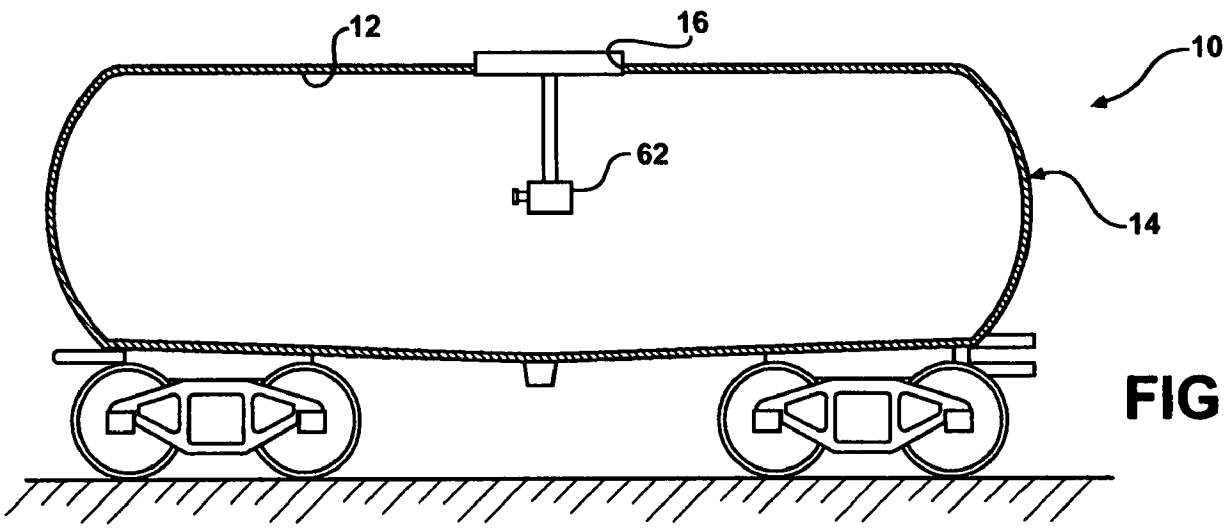

Upon completing the rinsing procedure, as shown in FIG. 1E, the rail car 14 may be inspected, such as with a camera 62 disposed within the rail car 14 along with suitable lighting, or by a person. If the inspection shows any residue, a standard power hose can be used to spot clean the inner surface 12 of the rail car 14.

The pump assembly 52, as shown in FIGS. 2-4 constructed according to one aspect of the invention, has a frame 64 supported on a pair of front and rear casters 66, 67 to facilitate moving the pump assembly 52 from one location to another to increase its usefulness. The casters 66, 67 are lockable to prevent movement of the pump assembly 52 while in use, and otherwise unlockable to allow the pump assembly 52 to be transported on the casters 66, 67. At least one pair of casters 67 may be pivotable to facilitate turning the pump assembly 10.

The frame 64 may include a top surface 68 supported by a plurality of upright supports 70 extending upwardly from a base 72 and defining a space between the base 72 and the top surface 68. Within the space, as best shown in FIG. 3, a motor 74 and a pump 76 may be carried in operable communication with one another on the base 72. The motor 74 is represented here, for example and without limitations, as a General Electric Model No. S245, having the following specifications: 15 hp, 230/460 VAC 3 phase, 60 hz, and a 254 T frame. The pump 76 is represented, for example and without limitations, as a Cat Triplex plunger, with a 316 stainless steel manifold. The pump 76 can deliver 800 psi at 27 gallons per minute (gpm), and has a 42 amp current draw. The pump 76 requires 4 inches of head minimum, and generally requires 35 gpm of fluid to be available. Other motors and pumps may be used, such as, by way of example and without limitations, a 25 hp motor and a pump delivering 150 psi at 78 gpm.

Figure 6:
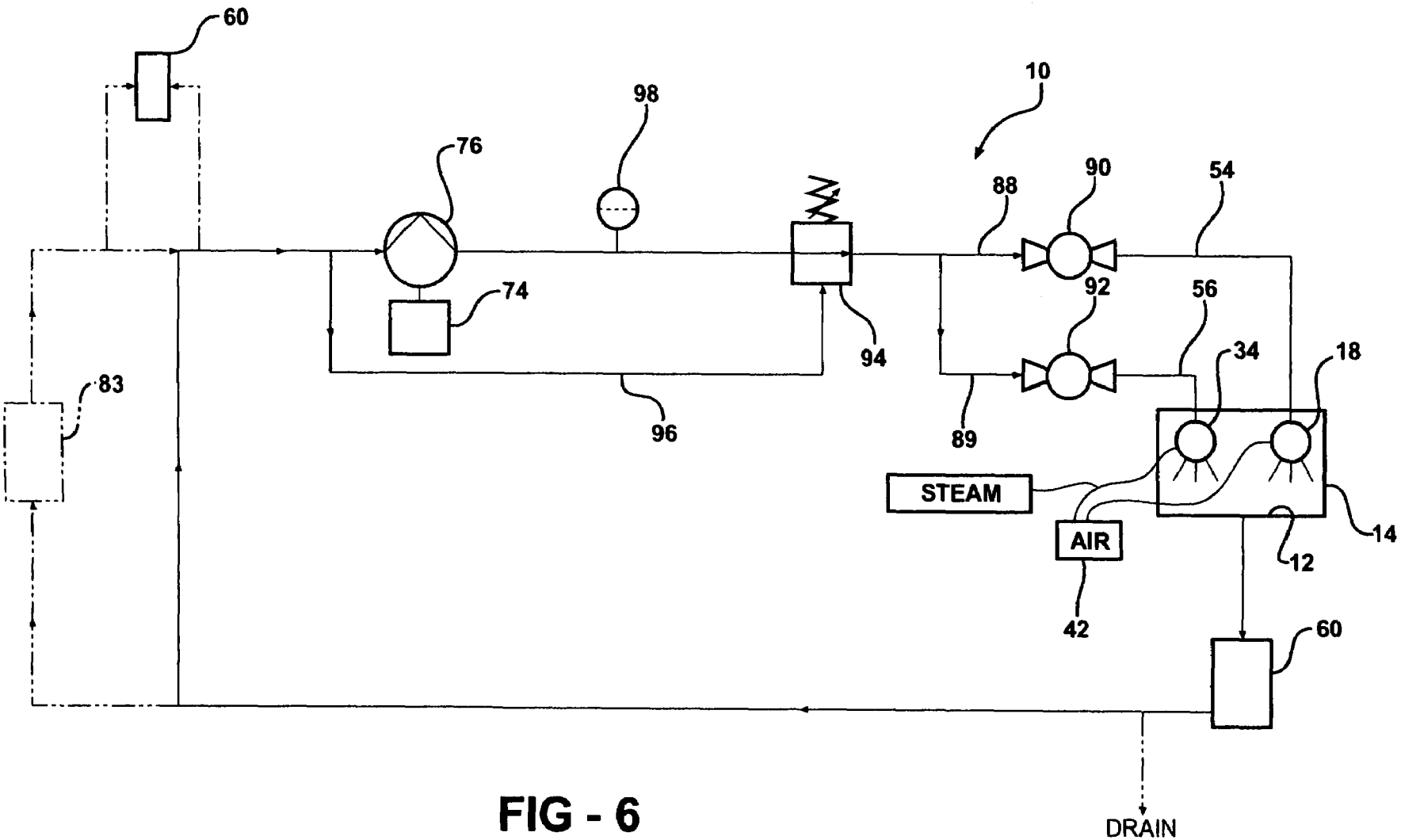
FIG. 6 is a schematic control diagram for one embodiment of the cleaning apparatus system of the invention.
Figure 7:
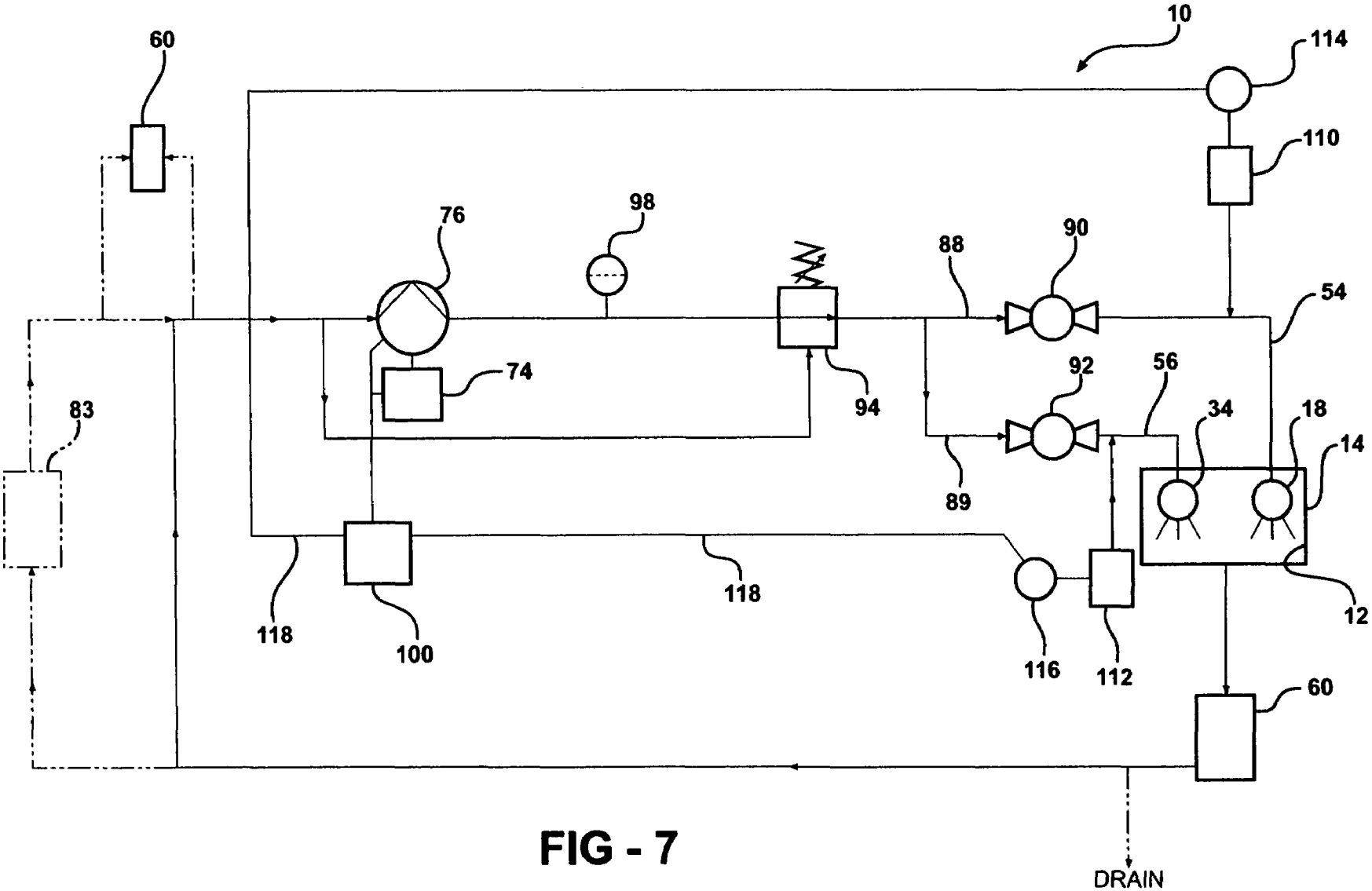
FIG. 7 is another schematic control diagram showing another embodiment.

The pump 76 may include an inlet connector 78 (FIGS. 2 and 3) with a pair of inlet openings 80, 81, with one of the openings 80 being arranged for connection to a supply hose, such as the return hose 58, providing fluid communication in a recirculation mode with the fluid in the rail car tank 14 being cleaned (FIGS. 1A-1E, 6 and 7), or with a separate container of solution 83, for example, cleaner solutions available from ReNew Systems, Inc., for directing the solution into the pump 76 and through an outlet 82 (FIGS. 3, 6 and 7) of the pump 76. As shown in FIGS. 3 and 4, an outlet fluid line or conduit 84 may extend from the outlet 82 to a bifurcated junction 86 where the conduit 84 diverges into two separate output conduits 88, 89. As shown in FIGS. 4, 6 and 7, each separate conduit 88, 89 has a manually or electrically operated valve, represented here, for example, as ball valves 90, 92 for operably turning the flow of fluid through the separate output conduits 88, 89 on or off, as desired.

To prevent unwanted pressure buildup in the outlet conduit 84, a pressure regulating valve 94 may be inserted between the junction 86 and the outlet 82 of the pump 76 in fluid communication with a bypass conduit 96. The bypass conduit 96 redirects fluid back to the inlet opening 81 of the inlet connector 78. To provide an operator with a precise pressure reading, a pressure gauge 98 may be attached to the outlet conduit 84 between the pressure regulating valve 94 and the outlet 82 of the pump 76. The pressure regulating valve 94 may be adjustable to regulate the pressure through the valve 94. Accordingly, an operator can adjust the amount of fluid pressure traveling to the pair of output conduits 88, 89 downstream of the pressure regulating valve 94.

Referring again to FIG. 2, a control module 100 may be carried by the frame 64, such as by being attached to one or more of the upright supports 70. The control module 100 may have a power cord with a plug adaptor constructed for attachment to a standard 220V power supply. The control module 100 may be in electrical communication via a wire harness with the motor 74 and the pump 76. The control module 100 allows an operator to adjust the speed of the motor 74, and thus, the gpm of fluid output of the pump 76.

As shown in FIGS. 2 and 4, a pair of hose reels 104, 105 may be rotatably carried by the frame 64, such as by being supported on the top surface 68 of the frame 64. Each hose reel 104, 105 may have a separate one of the hose lines 54, 56 coiled about a separate hollowed axle (FIG. 3) with an end (not shown) of each hose line 54, 56 attached in fluid communication with a separated one of the hollowed axles. Each axle may be supported by a pair of bearing blocks. Each of the pair of output conduits 88, 89 may be attached in fluid communication with a separate one of the hose lines 54, 56 via the hollowed axles at a separate inlet port 106 in each of the separate axles. Accordingly, with the valves 90, 92 in their open or on position, fluid is free to flow through the output conduits 88, 89, through the hollowed axles, and through the separate hose lines 54, 56. Accordingly, one or both of the hose lines 54, 56 may be used, depending on whether one or both of the valves 90, 92 is in the on or off position, as desired.

As shown in FIG. 6, the cleaning system 10 may use both of the hose lines 54, 56 for dispensing the cleaner solution 11 from the misting head 18 and jet stream head 34. As mentioned above, depending on the application of the cleaning system 10, any suitable spray nozzle may be attached to the ends of the hose lines 54, 56. Accordingly, while an operator attaches one of the misting head 18 or jet stream head 34 to one hose line 54 to clean the inner surface 12 of the tank 14, a separate spray nozzle (not shown) may be attached to the other hose line 56 to spray an external surface of the tank 14, or some other surface, as desired. This is particularly useful when cleaning tanker truck vessels, rail car vessels, pharmaceutical tanks, food processing tanks, paint blenders, and other large storage tanks, for example.

Another embodiment of a cleaning apparatus 10 is shown schematically in FIG. 7, wherein at least one, and optionally a pair of chemical solution tanks as shown at 110 and 112, are attached for fluid communication between the pair of ball valves 90, 92 and the spray heads 18, 34. The chemical solution tanks 110, 112 can be equipped with separate pumps 114, 116 for controlling the disbursement of the chemical solution within the tanks 110, 112 into a separate one of the hoses 54, 56. In addition, the pumps 114, 116 for the cleaner solution tanks 110, 112 may be operably controlled or programmed at the control module 100 through electrical connections or wires 118 between the control module 100 and the pumps 114, 116. Accordingly, each chemical solution tank 110, 112 may have a different chemical solution therein, thereby providing the operator with the ability to dispense different chemical solutions with different mixture concentrations from each head 18, 34, depending on the type of cleaning being performed.

It should be recognized that the embodiments discussed above are exemplary embodiments, and thus, are intended to be illustrative and not limiting. The scope of the invention is defined by the following claims.

What is claimed is:

1. A cleaning apparatus for cleaning an inner surface of a container, the apparatus comprising:

a fluid pump;

a first spray head arranged for operable fluid communication with the fluid pump and having a nozzle configured to disperse liquid in a mist; and a mount carrying the first spray head and configured to be removably supported on a container having an inner surface to be cleaned, and further configured to support the first spray head in a position within the container to be cleaned, the pump being arranged to draw liquid from the container to be cleaned and to pump the liquid back into the container through the first spray head.

2. The cleaning apparatus of claim 1 in which the first spray head is configured to issue a mist comprising fine droplets of liquid on the order of a micron or less in diameter.

3. The cleaning apparatus of claim 1 in which the first spray head is arranged to operate in a closed recirculatory loop with the pump.

4. The cleaning apparatus of claim 3 in which the pump is configured to draw liquid from a pool of liquid formed in the container from liquid dispersed into the container by the first spray head, and to pump that liquid back to the first spray head in a recirculatory fashion.

5. The cleaning apparatus of claim 1 further comprising a heat source configured to heat liquid to be dispersed by the first spray head.

6. The cleaning apparatus of claim 5 in which the heat source comprises a steam line in operable communication with a pressurized air line.

7. The cleaning apparatus of claim 1 including an enzymatic solution arranged for fluid communication with the first spray head, the first spray head being configured to disperse the enzymatic solution in a mist.

8. The cleaning apparatus of claim 1 in which the first spray head is configured to disperse liquid in a mist in a pattern producing a fog-like atmosphere within a container to be cleaned.

9. The cleaning apparatus of claim 1 in which the first spray head comprises a plurality of spray nozzles, each configured to dispense liquid in a mist.

10. The cleaning apparatus of claim 1 in which the first spray head is configured to disperse liquid in a mist over a 360 degree circular spray pattern.

11. The cleaning apparatus of claim 1 in which the mount includes a lid configured to be removably supported over an opening in a container to be cleaned.

12. The cleaning apparatus of claim 1 in which the lid is configured to provide a liquid-tight seal with an opening in a container to be cleaned.

13. The cleaning apparatus of claim 1 further including a second spray head carried by the mount in a position to be disposed within a container to be cleaned when the mount is supported on such a container, the second spray head having a nozzle configured to dispense liquid in a high pressure liquid stream.

14. The cleaning apparatus of claim 13 in which the nozzle of the second spray head is in operable fluid communication with the pump.

15. The cleaning apparatus of claim 13 in which the nozzle of the second spray head is movably supported.

16. The cleaning apparatus of claim 13 in which the nozzle of the second spray head has a rifled bore configured to direct fluid passing through the nozzle into a vortical stream.

17. The cleaning apparatus of claim 13 in which the second spray head is arranged to operate in a closed recirculatory loop with the pump.

18. The cleaning apparatus of claim 13 including at least one chemical solution container arranged for fluid communication with at least one of the first and second spray heads.

19. The cleaning apparatus of claim 13 in which separate chemical solution containers are arranged for fluid communication with the respective first and second spray heads.

20. The cleaning apparatus of claim 1 in which the fluid pump is carried by the mount.

21. The cleaning apparatus of claim 1 in which the fluid pump is configured to provide liquid under pressure to be mixed with pressurized gas and dispersed through the first spray head into a container to be cleaned.

* * * * *